US005868219A

United States Patent [19]

Sadeck et al.

[11] Patent Number: 5,868,219

[45] Date of Patent: Feb. 9, 1999

[54] RAPPEL ROPE STORAGE AND DEPLOYMENT SYSTEM

[75] Inventors: James E. Sadeck, East Freetown, Mass.; Archie Sanders, Bonner Springs, Kans.

[73] Assignee: The United States of America as represented by the Secretary of the Army, Washington, D.C.

[21] Appl. No.: 990,263

[22] Filed: Dec. 15, 1997

[51] Int. Cl.[6] ..... A62B 1/06

[52] U.S. Cl. ..... 182/70; 182/190; 188/65.1; 188/65.2; 224/576

[58] Field of Search ..... 185/5, 6, 7, 8, 185/70, 190, 191, 192; 188/65.1, 65.2, 65.3, 65.4; 224/576; 206/388

[56] References Cited

U.S. PATENT DOCUMENTS

| | | | |
|---|---|---|---|
| 705,891 | 7/1902 | Abrams | 182/70 X |
| 3,692,145 | 9/1972 | Banner | 182/70 |
| 4,102,431 | 7/1978 | Carroll et al. | 182/5 |
| 4,662,517 | 5/1987 | Wirth | 206/388 |
| 4,688,674 | 8/1987 | Stirtz | 206/388 |
| 4,714,135 | 12/1987 | Bell et al. | 182/6 |
| 4,730,696 | 3/1988 | Johnson | 182/70 X |
| 5,421,457 | 6/1995 | Listenberger | 206/388 |
| 5,439,109 | 8/1995 | McBride | 206/388 |
| 5,690,187 | 11/1997 | Wnag et al. | 182/70 |

*Primary Examiner*—Daniel P. Stodola
*Assistant Examiner*—Richard M. Smith
*Attorney, Agent, or Firm*—Vincent J. Ranucci

[57] ABSTRACT

A rappel rope storage and deployment system includes a bag for storing a rappel rope, the bag having a first opening for exposing a first end of the rope, a second opening for exposing a middle portion of the rope, and a third opening for exposing a second end of the rope. The system further includes a rappel rope disposed in the bag, the first end of the rope extending through the first opening and outwardly from the bag, the first end being enlarged to prevent passage of the first end through the first opening, the middle portion of the rope extending through the second opening for withdrawal of a double strand of the rope from the second opening, and the second end of the rope extending through the third opening for withdrawal of a single strand of the rope from the third opening. The system further includes straps and fasteners for releasably connecting the bag to a person.

19 Claims, 2 Drawing Sheets

RAPPEL ROPE STORAGE AND DEPLOYMENT SYSTEM

BACKGROUND OF THE INVENTION

1. Field of the Invention

The invention relates to rappel rope systems of the type used in descent from steep terrain or man-made structures, and is directed more particularly to a rappel rope storage and deployment system which easily can be carried by a person and used in emergency life support exercises, and the like.

2. Description of the Prior Art

The use of rappel ropes for descent from natural or man-made heights is well known. Typically, however, the ropes themselves are large and heavy and cannot be stored on the body of an individual. Further, existing systems require that the rope be deployed before use. The deployment sometimes results in entanglements in the rope coil. It also results in the free end of the rope hanging below the descending individual, which can be detrimental in tactical situations.

The advent of high strength, small diameter rappel rope, including rope of 5 millimeter diameter, and less, has made possible more compact storage of rope and new methods for handling the rope. Inasmuch as a relatively long rappel rope can be carried by a person, there is now a need for a compact rappel rope storage and deployment system which can be carried on a person and deployed when needed. There is further a need for such a system that can be used in emergency and tactical situations and wherein the rope does not hang below the person using the rope.

SUMMARY OF THE INVENTION

An object of the invention is, therefore, to provide a rappel rope storage and deployment system which may be carried by an individual and deployed when needed.

A further object of the invention is to provide such a system wherein the rope does not hang beneath the individual using the rope for descent.

A still further object of the invention is to provide the individual using the system with an election to use either single rope strength or double rope strength.

With the above and other objects in view, as will hereinafter appear, a feature of the present invention is the provision of a rappel rope storage and deployment system, the system comprising a bag for storing a rappel rope, the bag having a first opening for exposing a first end of the rope, a second opening for exposing a middle portion of the rope, and a third opening for exposing a second end of the rope. The system further comprises a rappel rope disposed in the bag. The first end of the rope extends through the first opening and outwardly from the bag, the first end being enlarged to prevent passage of the first end through the first opening. The middle portion of the rope extends through the second opening for withdrawal of a double strand of the rope from the second opening. The second end of the rope extends through the third opening for withdrawal of a single strand of the rope from the third opening. The system still further comprises means for connecting the bag to a person.

The above and other features of the invention, including various novel details of construction and combinations of parts, will now be more particularly described with reference to the accompanying drawings and pointed out in the claims. It will be understood that the particular system embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
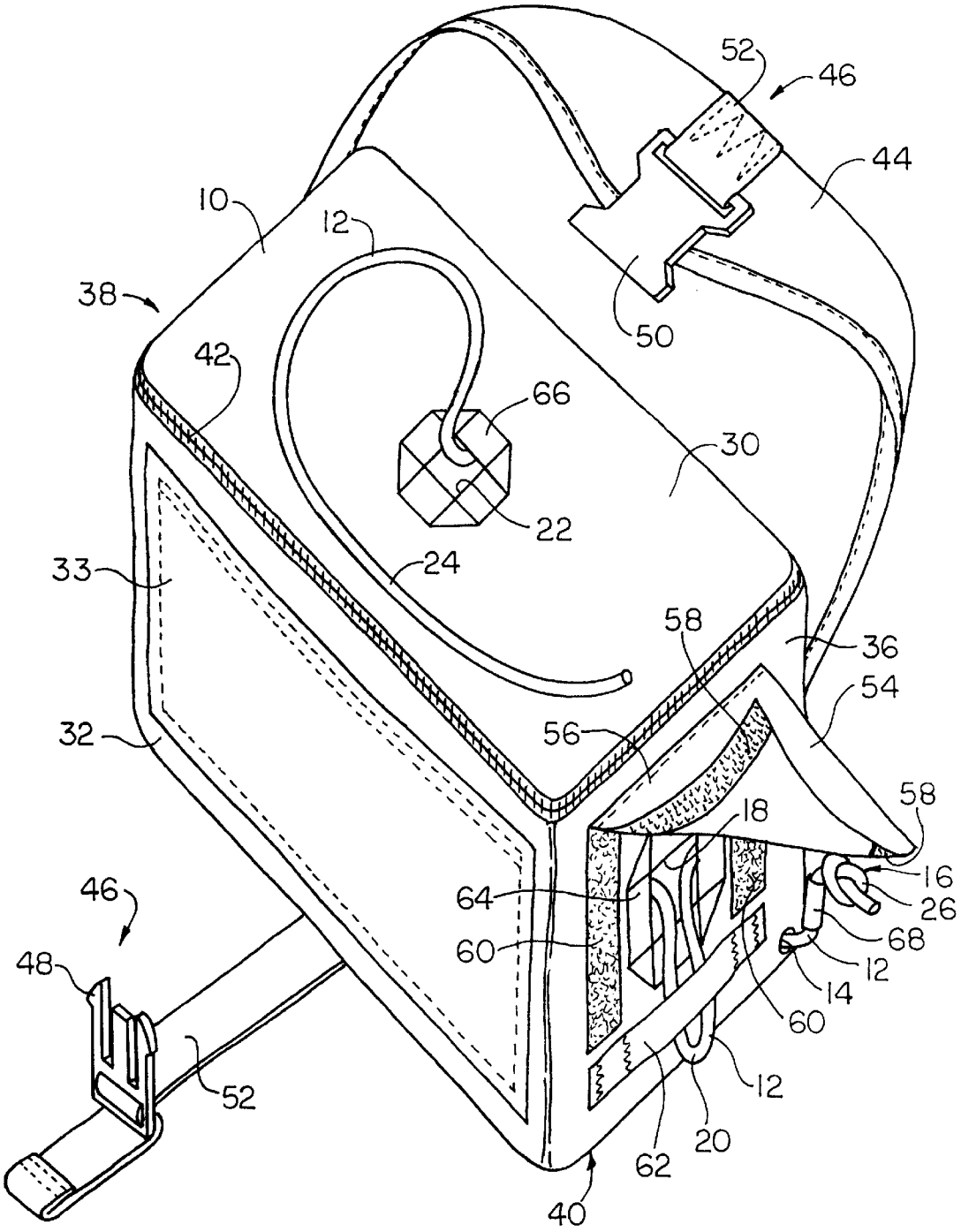
FIG. 1 is a perspective view showing top, front, and first end portions of one form of a rappel rope storage and deployment system illustrative of an embodiment of the invention.

Referring to FIG. 1, it will be seen that the illustrative rappel rope system includes a bag 10 for storing a rappel rope 12. The bag 10 is provided with a first opening 14 for exposing a first end 16 of the rope 12, a second opening 18 for exposing a middle portion 20 of the rope 12, and a third opening 22 for exposing a second end 24 of the rope 12.

The rappel rope 12 disposed in the bag 10 is of about 5 mm diameter, or less, and includes the first end 16 of the rope 12 extending through the first opening 14 and outwardly from the bag 10. The first end 16 of the rope 12 is enlarged, as by a knot 26, to prevent passage of the rope first end 16 through the bag first opening 14. The middle portion 20 of the rope 12 extends through the second opening 18 for withdrawal of a double strand of the rope 12 from the second opening 18. The second end 24 of the rope 12 extends through the third opening 22 for withdrawal of a single strand of the rope 12 from the third opening 22.

Figure 2:
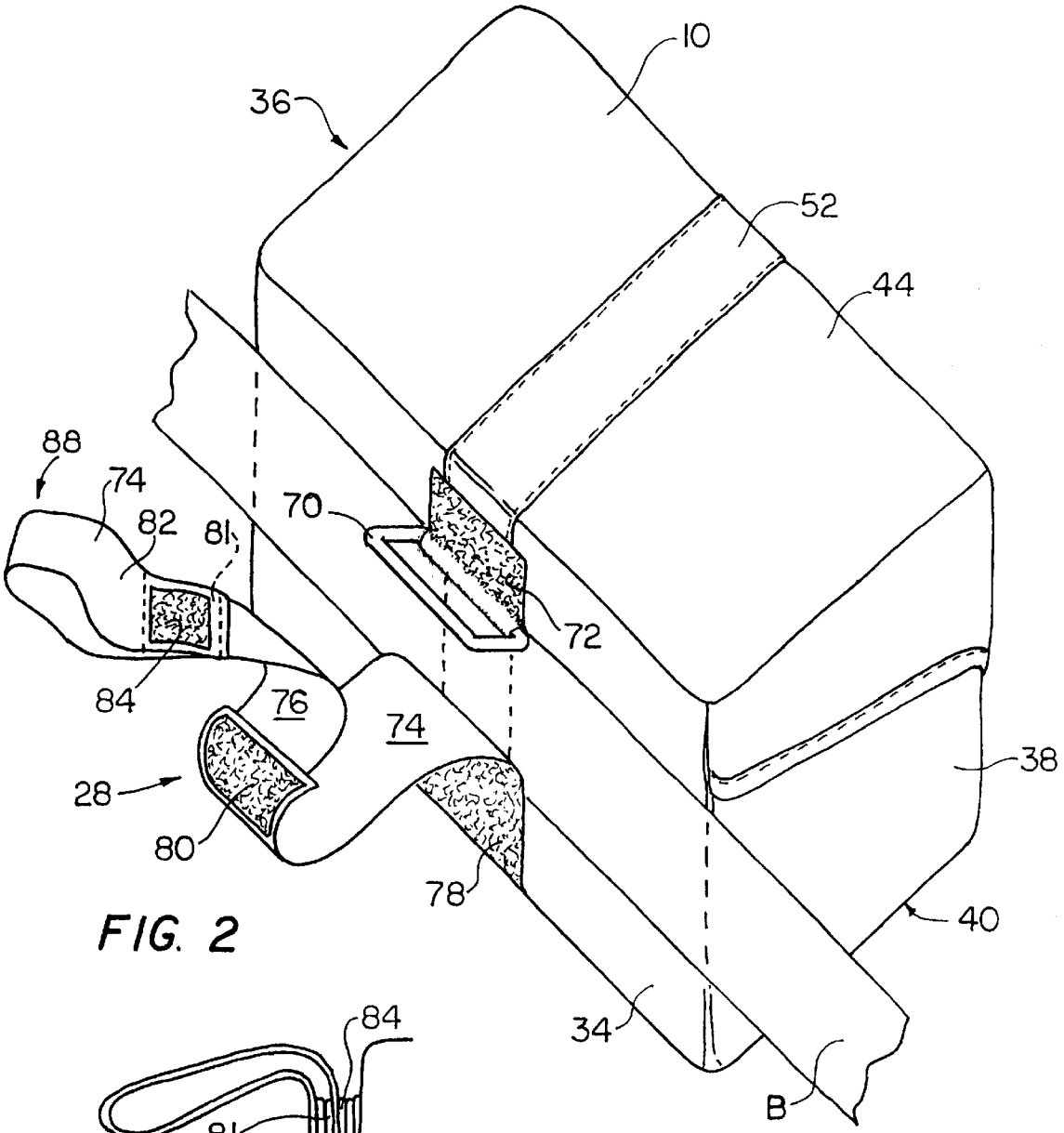
FIG. 2 is a perspective view similar to FIG. 1, but showing top, rear, and second end portions of the system.
Figure 3:
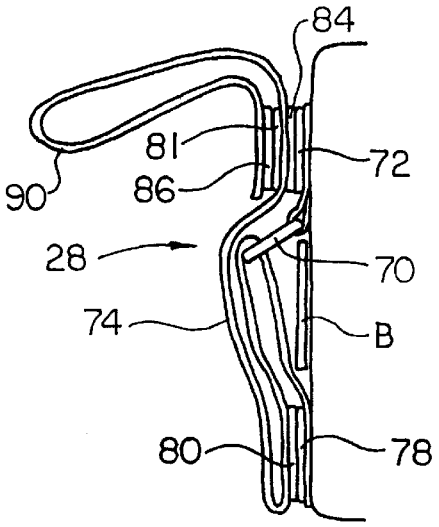
FIG. 3 is a side elevational view of a portion of the system of FIG. 2.

Referring to FIGS. 2 and 3, it will be seen that the bag 10 is provided with means 28 for connecting the bag to a rappel belt B or other similar wearing apparel, such as a rappel harness or vest. The connecting means 28 will be described hereinbelow.

The bag 10 is provided with a top flap 30 (FIG. 1), a front side wall panel 32, on which there may be disposed an outside pocket 33 (FIG. 1), a back side wall panel 34 (FIG. 2), a first end wall panel 36 (FIG. 1), a second end wall panel 38 (FIG. 2), and a bottom panel 40. The top flap 30 is removeably connected to the front side wall panel 32 and the first and second end wall panels 36, 38 by a readily releasable connector 42 (FIG. 1), such as a zipper. Thus, the top flap 30 is in part removable from the wall panels 32, 36, 38 to permit placement of the rope 12 in the bag 10.

The third opening 22 extends through the top flap 30 to permit extension of the rappel rope second end 24 therethrough.

The bag 10 is further provided with a protector flap 44 for securing over the top flap 30 and the rope second end 24. The protector flap 44 in FIG. 2 is at least in part removable from the bag 10 as, for example, along the front side and end wall panels 32, 36, 38, as shown in FIG. 1, to expose the top flap 30 and the rope second end 24. To secure the protector flap 44 in a closed position, there is provided a quick-release strap and buckle assembly 46 (FIG. 1), including first and second buckle components 48, 50 at either end, respectively, of strap 52.

Referring still to FIG. 1, a second protector flap 54 is connected at one edge 56 to the bag first end 36 and is adapted to overlie the second opening 18 and at least a part of the rope middle portion 20 extending therefrom. The second protector flap 54 is provided with two hook and pile type strips 58 which are engageable, respectively, with hook and pile type strips 60 fixed to the bag first end 36.

The rope middle portion 20 is of a U-bend configuration, as shown in FIG. 1, and is held against the bag first end 36 by a retainer band 62.

Preferably, the bag first end 36 is provided with reinforcement 64 around the second opening 18. In like manner, the top flap 30 is provided with reinforcement 66 around third opening 22.

Referring again to FIG. 1, it will be seen that a tube 68, preferably of a thick webbing material, is disposed on the rope first end portion 16 external to the first opening 14. The tube 68 is larger in diameter than the first opening 14 and serves to prevent the rappel rope 12 from slipping through the first opening 14. To ensure that the rope does not pass through the first opening 14, the rope is knotted to provide the knot 26 which is greatly larger than the diameter of the tube 68 and the first opening 14. Thus, if under heavy strain the tube 68 passes through the first opening 14, the knot 26 prevents further movement.

Referring to FIGS. 2 and 3, it will be seen that the aforementioned means 28 for connecting the bag 10 to a person's belt, vest or harness B, includes a rectangularly-shaped ring 70 fixed at one side to the back side wall panel 34. A hook and pile type fastener 72 is fixed to the back wall portion of the protector flap 44. A strap 74 is fixed to the back side wall portion 34 of the bag 10, spaced from the fastener 72. The strap 74 has affixed to a first side 76 thereof spaced apart hook and pile type fasteners 78, 80, 81 and 86 and on a second side 82 thereof a further hook and pile type fasteners 84.

To attach the rappel belt, or the like, B to the bag 10, the strap 74 is fed over the belt B (FIG. 3), through the ring 70, back to interconnect the fasteners 78, 80, back again over the ring 70 to interconnect the fasteners 72, 84. The free end 88 of the strap 74 is then formed into a loop 90 and the fastener 86 interconnected with the fastener 81. The strap 74 thereby captures the belt B and provides the loop 90 by which the belt wearer may quickly disengage the bag 10 from the belt B.

In operation, the bag 10, with the rappel rope 12 stored therein, is affixed to a wearer/operator belt B as described immediately above. When needed for a rappeling operation, the rappel rope second end 24 is drawn from the opening 22 and made secure to a selected support (not shown). Holding the rappel rope, the operator rappels down the rope 12, while rope is fed out of the opening 22. The rope does not hang beneath the operator.

In the event a stronger rope is deemed beneficial, as when the operator is carrying heavy equipment or another person, the operator may withdraw a double strand of rope from the opening 18, rather than the single strand from the opening 22.

Upon reaching the desired lower level, the operator may yank on the strap loop 90 to disengage the various fasteners and free the bag 10 from the belt B of the operator.

There is thus provided a rappel rope and storage deployment system which may be carried by an individual and deployed when needed, which in use does not hang beneath the operator, and which provides the operator with an election as to use of single or double rope strength in a particular operation.

It is to be understood that the present invention is by no means limited to the particular construction herein disclosed and/or shown in the drawings, but also comprises any modifications or equivalents within the scope of the claims.

What is claimed is:

1. A rappel rope storage and deployment system, the system comprising:

a bag for storing a rappel rope, said bag having a first opening for exposing a first end of said rope, a second opening for exposing a middle portion of said rope, and a third opening for exposing a second end of said rope;

said bag further comprising a top flap, front and back side wall panels, first and second end wall panels, and a bottom panel, and said top flap is at least in part removable from said wall panels to permit placement of said rope in said bag;

said third opening extending through said top flap to permit extension of said rope second end therethrough;

a rappel rope disposed in said bag, said first end of said rope extending through said first opening and outwardly from said bag, said first end being enlarged to prevent passage of said first end through said first opening, said middle portion of said rope extending through said second opening for withdrawal of a double strand of said rope from said second opening, and said second end of said rope extending trough said third opening for withdrawal of a single strand of said rope from said third opening; and means for connecting said bag to a person.

2. The rappel rope system in accordance with claim 1 wherein said bag further comprises a protector flap for securing over said bag top flap and over said second end of said rope, and at least in part removable from said bag to expose said top flap and said rope second end.

3. The rappel rope system in accordance with claim 2 wherein said bag is provided with a strap and buckle assembly for said securing of said protector flap over said top flap.

4. The rappel rope system in accordance with claim 3 wherein a buckle portion of said strap and buckle assembly comprises first and second interconnecting members which when connected to each other are disposed adjacent said front side wall panel.

5. The rappel rope system in accordance with claim 4 wherein said strap and buckle assembly includes a strap free end portion adapted to be pulled by the person to tighten said strap around said bag.

6. The rappel rope system in accordance with claim 2 wherein said means for connecting said bag to a person comprises means for connecting said bag to a selected one of a rappel belt, vest and harness.

7. The rappel rope system in accordance with claim 6 wherein said means for connecting said bag to a person comprises means for connecting said bag to a rappel belt worn by the person and comprises a first pile and hook type fastener fixed to said protector flap proximate said back side wall panel, a rigid ring fixed to said bag proximate a bottom-most edge of said protector flap, a second pile and hook type fastener fixed to said back side wall panel proximate said bottom panel and aligned with said first fastener and spaced from said first fastener a sufficient distance for unobstructed disposal of said rappel belt of the person on said back side wall surface therebetween, a locking belt fixed at a first end thereof to said back side wall panel proximate an upper-most edge of said second fastener, said locking belt being extendible through said rigid ring and back toward said second fastener, a third pile and hook type fastener disposed on said locking belt and interengageable with said second fastener, said locking belt being extendible back toward said second fastener, a fourth pile and hook type fastener disposed on said locking belt and engageable with said first fastener such that said locking belt is disposed over said rappel belt and retains said rappel belt adjacent said bag back side wall panel.

8. The rappel rope system in accordance with claim 7 wherein said locking belt includes a free end portion extending beyond said fourth fastener and comprising a grip portion to facilitate a quick release for said fourth fastener from said first fastener and said third fastener from said second fastener to disengage said bag from said rappel belt.

9. The rappel rope system in accordance with claim 8 wherein said locking belt grip portion comprises a loop.

10. The rappel rope system in accordance with claim 1 wherein said second opening extends through one of said end wall panels to permit extension of said rope middle portion therethrough.

11. The rappel rope system in accordance with claim 10 wherein said bag further comprises a second protection flap for securing over said bag second opening and at least in part over said rope middle portion, and at least in part removable from said bag to expose said rope middle portion.

12. The rappel rope system in accordance with claim 11 wherein said rope middle portion comprises a U-shaped bend of said rope, and said bag further comprises a retainer band fixed to said bag and in part covering said rope middle portion.

13. The rappel rope system in accordance with claim 11 wherein said second protector flap and said bag are provided with complementary strips of hook-and-pile type fastener, for releasably securing said second protector flap to said bag.

14. The rappel rope system in accordance with claim 1 wherein said top flap is provided with reinforcement material around said third opening, and said bag is provided with reinforcement material around said second opening.

15. The rappel rope system in accordance with claim 1 and further comprising a substantially rigid tube disposed on said rope proximate the first end thereof and external of said bag, said tube being of larger diameter than said first opening, to prevent said rope first end from passing through said first opening.

16. The rappel rope system in accordance with claim 15 wherein said rope is knotted outwardly from said tube to prevent said rope first end from passing through said tube and said first opening.

17. The rappel rope system in accordance with claim 1 wherein said bag is provided with an external pocket on said front side wall panel.

18. The rappel rope system in accordance with claim 1 wherein said top flap is secured to said bag walls at least in part by a zipper.

19. The rappel rope system in accordance with claim 1 wherein said rope is of a diameter of no more than about 5 millimeters.

* * * * *